US005603361A

United States Patent [19]

Cuisinier

[11] Patent Number: 5,603,361

[45] Date of Patent: Feb. 18, 1997

[54] PORTABLE WATER BALLOON AND CONTAINER FILLER

[76] Inventor: Jarret P. Cuisinier, 4132 E. Grandview Cir., Mesa, Ariz. 85205

[21] Appl. No.: 324,886

[22] Filed: Oct. 18, 1994

[51] Int. Cl.[6] ..... A63H 33/00

[52] U.S. Cl. ..... 141/26; 141/67; 141/313; 141/317; 141/95; 446/28; 446/267; 446/473; 222/79; 222/175

[58] Field of Search ..... 141/2, 3, 18, 21, 141/25–28, 67, 95, 114, 313, 314, 317, 10; 222/79, 175; 446/28, 267, 473; 124/73, 74, 76; 53/390, 570

[56] References Cited

U.S. PATENT DOCUMENTS

| | | | |
|---|---|---|---|
| 2,281,142 | 4/1942 | Davis | 299/97 |
| 2,515,568 | 7/1950 | Pharo | 222/401 |
| 2,701,672 | 2/1955 | Glasco | 141/313 |
| 2,912,791 | 11/1959 | Cohen | 141/313 X |
| 3,197,070 | 7/1965 | Pearl et al. | 222/79 |
| 3,318,482 | 5/1967 | Voce | 222/79 |
| 3,499,444 | 3/1970 | Koutsandreas | 141/26 X |
| 4,214,674 | 7/1980 | Jones et al. | 222/79 |
| 4,257,460 | 3/1981 | Parany et al. | 141/26 |
| 4,591,071 | 5/1986 | Johnson | 222/39 |
| 4,869,402 | 9/1989 | Ash, Jr. | 222/175 X |
| 4,946,413 | 8/1990 | Lehmann et al. | 446/28 |
| 4,955,412 | 9/1990 | Younts et al. | 141/114 |
| 5,074,437 | 12/1991 | D'Andrade et al. | 222/79 |
| 5,123,460 | 6/1992 | Reed | 141/95 |
| 5,141,462 | 8/1992 | Latzel | 446/28 |
| 5,154,317 | 10/1992 | Roppolo III | 222/66 |
| 5,186,391 | 2/1993 | Roueche et al. | 239/373 |
| 5,238,149 | 8/1993 | Johnson et al. | 222/79 |
| 5,279,340 | 1/1994 | Scherr et al. | 141/313 |
| 5,318,202 | 6/1994 | D'Andrade | 222/79 X |
| 5,337,540 | 8/1994 | Carroll | 53/390 X |
| 5,366,108 | 11/1994 | Darling | 222/175 X |

OTHER PUBLICATIONS

"Water Bomb Kit", Betta Productions, Inc., Copyright 1993 It is a small water balloon filler that relies on an exterior water source (ex. Bucket).

*Primary Examiner*—J. Casimer Jacyna
*Attorney, Agent, or Firm*—Cahill, Sutton and Thomas P.L.C.

[57] ABSTRACT

A portable dispenser is adapted to filling water balloons and water pistols. A reservoir is pressurized by a hand pump that draws air in from the atmosphere and forces the air into the reservoir. The pressure in the reservoir forces water down a flexible tube to a trigger mechanism in a water pistol. The trigger mechanism performs three functions: it throttles the water, it acts as relief valve by releasing water if the pressure is greater than a predetermined limit, and it indicates the pressure within the reservoir. When the trigger mechanism is actuated, water flows through the mechanism to a valve that directs the water either to a filling nozzle or to a spraying nozzle. In an alternative embodiment, the pump takes water from a storage chamber within the reservoir and pumps it into a high pressure chamber within the reservoir.

16 Claims, 6 Drawing Sheets

PORTABLE WATER BALLOON AND CONTAINER FILLER

BACKGROUND OF THE INVENTION

This invention relates to a portable dispenser having a pressurized reservoir for storing water and, in particular, to a portable dispenser for filling water balloons and water pistols.

In the prior art, balloons and water pistols could be filled only from a water faucet. This has a number of disadvantages. For example, the range at which water balloons and water pistols can be filled and used is significantly reduced because a user must stay near the faucet. Stretching the mouth of a water balloon over the faucet causes great stress on the balloon, often leading to rupture of the balloon or a rip of the mouth of the balloon. A faucet does not direct the water well, making it difficult to fill a water pistol through the small hole typically available on the pistol.

Water balloons are rarely used in water fights because of the time, care, and inconvenience involved in filling even one balloon. It takes time to leave a water fight, go to the nearest faucet, fill a balloon, and then return to the water fight. The balloon must be filled with care to avoid rupturing or ripping the balloon, which further increases the time away from the fun of a water fight. It is inconvenient to interrupt a water fight for re-filling, often at the same faucet as ones opponents. Much of the sense of competition and of action is usually lost, causing the fight to be short-lived and preventing it from reaching a climax of fun. The situation is much the same with small capacity water pistols, with the added disadvantage of spilling water around the faucet, creating huge, muddy messes in the surrounding area. For these reasons, many participants in water fights do not wish to use water balloons or small capacity water pistols.

Manufacturers of water pistols have tried to overcome some of these problems by increasing the size of the reservoir in the water pistol, until the water pistol is almost too heavy to operate while filled. The problem with water balloons has not been recognized.

Pressurized dispensers and, in particular, water pistols with pressurized reservoirs, are known in the art. The prior art does not disclose pressurized reservoirs for filling water balloons and water pistols from a self-contained, portable unit. Of particular interest is U.S. Pat. No. 4,214,674 (1980) to Lawrence T. Jones et al. which discloses a toy water pistol system that has a separate, but attached, pressurized reservoir. The reservoir is pressurized by a hand pump that forces water through flexible tubing to a pistol. The pistol includes a trigger that stops the water from flowing unless the trigger actuated. When the trigger is actuated, the water flows continuously through a nozzle. Also of particular interest is a "Water Bomb Kit" made by Betta Productions Inc. in which a hand-held, squeeze pump-fills water balloons by immersing an inlet of the pump into water and attaching a balloon to an outlet of the pump.

U.S. Pat. No. 2,281,142 (1942) to Ernest W. Davis, discloses a portable pumping apparatus for spraying insecticide or oil. U.S. Pat. No. 2,515,568 (1950) to Gorden C. Pharo, discloses a pump sprayer in which a tank or container is pressurized by operating an air compressor forcing liquid material out through a controlled dispensing spray nozzle. U.S. Pat. No. 3,197,070 (1965) to Curtis F. Pearl et al. discloses a toy fluid dispensing device or garden sprayer wherein a power piston is forced into a chamber filled with water collected from a connected tank. The power piston forces the water through the nozzle to project a spraying stream of about twenty-five feet. U.S. Pat. No. 3,318,482 (1967) to Carl Voce, discloses a water pistol having a single pump to collect water from a connected reservoir and to force the water through a nozzle on the pistol.

U.S. Pat. No. 4,257,460 (1981) to Bruce J. Parany et al. discloses a water pistol having a balloon-like pump system to discharge stored water in a spraying stream. U.S. Pat. No. 4,591,071 (1986) to Lonnie G. Johnson, discloses a pressurized squirt gun that shoots a continuous high velocity stream of water using a pressurized reservoir and a trigger for controlling the discharge of the water through a nozzle. U.S. Pat. No. 4,955,412 (1990) to Donna Younts et al. discloses an apparatus for injecting confetti into a balloon while inflating the balloon. U.S. Pat. No. 5,074,437 (1991) to Bruce M. D'Andrade et al. discloses a water gun that is operated by selectively releasing water from a pressurized reservoir. The reservoir is pressurized by a manual air pump. U.S. Pat. No. 5,123,460 (1992) to David A. Reed, discloses a multipurpose container system to be used for loading liquid dispensers. U.S. Pat. No. 5,141,462 (1992) to Michael R. Latzel, discloses a water gun including a balloon storage housing from which balloons are inflated by the release of compressed gas from a cylinder. A balloon is tethered to the gun for use as a target. U.S. Pat. No. 5,154,317 (1992) to Michael A. Roppolo, III, discloses a portable liquid dispenser for transporting large quantities of liquid to a predetermined location and for dispensing the liquid on demand. U.S. Pat. No. 5,186,391 (1993) to Wallace Roueche et al. discloses a portable sprayer including a piston pump to pressurize a container, a flexible tubing exiting the container, and a nozzle for spraying. U.S. Pat. No. 5,238,149 (1993) Lonnie G. Johnson et al. discloses a water pistol having a manual piston pump that pressurizes a reservoir with water and air from another reservoir, a trigger, and a spraying nozzle.

In view of the foregoing, it is therefore an object of the invention to provide a portable dispenser that enables one to fill water balloons and water pistols in a large territory.

Another object of the invention is to provide a portable dispenser having a nozzle adapted for filling water balloons and for providing a controlled stream of water for filling water pistols with little spillage.

A further object of the invention is to provide a portable, pressurized dispenser for conveniently filling water balloons and small capacity water pistols in the midst of a competition or a water fight.

Another object of the invention is to provide a neater and cleaner way of filling water balloons and water pistols.

A further object of the invention is to provide portable, pressurized dispenser for conveniently filling water balloons and small capacity water pistols away from a water faucet.

Another object of the invention is to provide a portable dispenser for liquids that stores empty or filled water balloons and stores other articles useful in a water fight.

A further object of the invention is to provide dispenser including a trigger that actuates a valve and indicates the pressure within a pressurized reservoir.

Another object of the invention is to provide a dispenser including a trigger that is also a relief valve for releasing pressure from a pressurized reservoir.

SUMMARY OF THE INVENTION

A portable dispenser acts as a portable faucet, adapted to filling water balloons and water pistols. A preferred embodiment of the dispenser includes a piston pump to pressurize a reservoir containing water. The pressure forces the water out of the reservoir when a trigger is pulled, operating a first valve. A second valve controls the direction of the water either through a nozzle for filling water balloons and water pistols or through an attached spray nozzle. In accordance with another aspect of the invention, the first valve provides three functions; controlling the flow of water, indicating water pressure, and relieving excessive pressure. In an alternative embodiment of the invention, the reservoir includes two or more chambers. At least one of the chambers is pressurized and an unpressurized chamber can be filled with water without relieving the pressure in the pressurized chamber.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
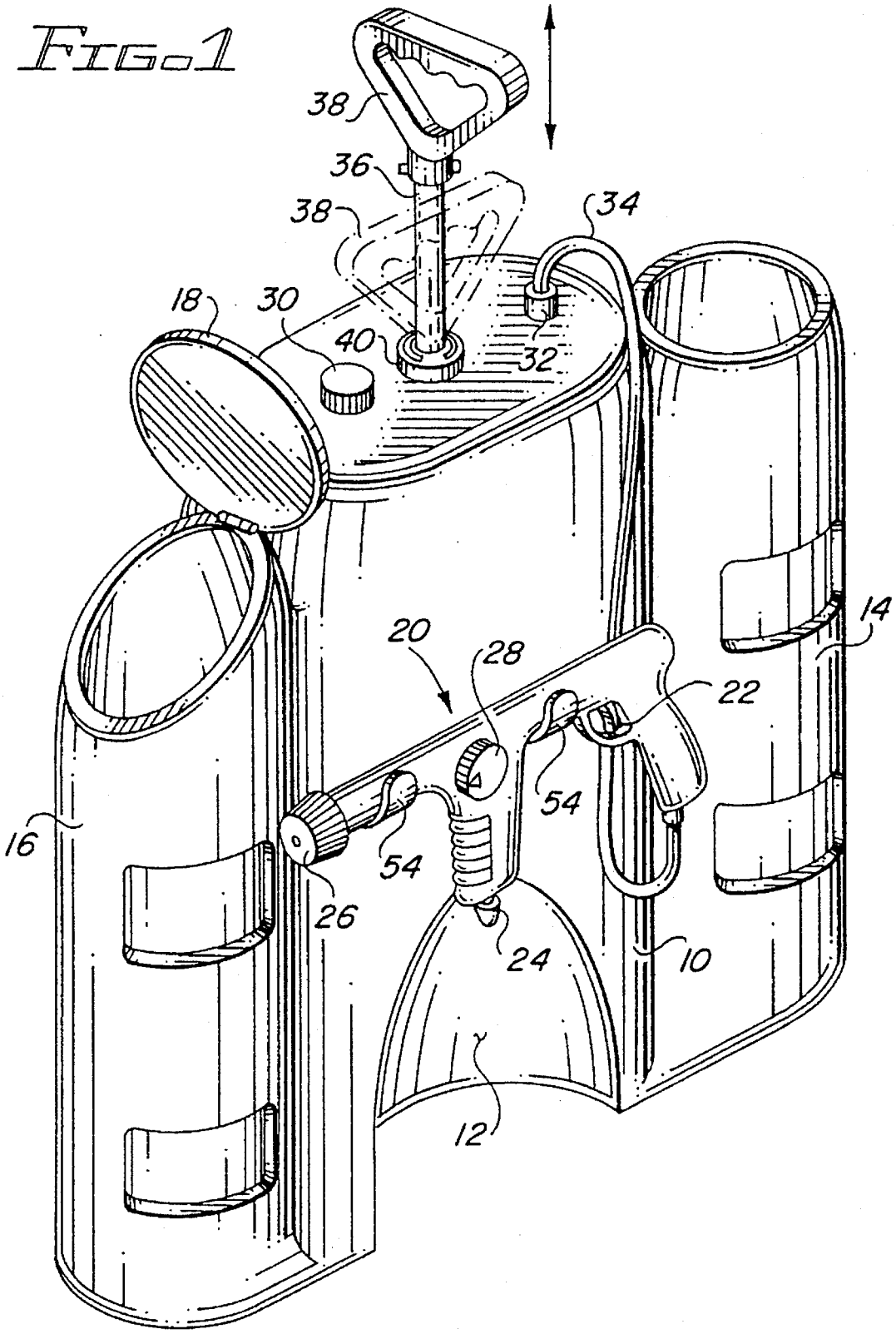
FIG. 1 is a perspective view of the front of a portable dispenser constructed in accordance with a preferred embodiment of the invention.

In FIG. 1, reservoir 10 is made of a rigid plastic capable of withstanding the pressure generated by a hand pump. Hollow 12 in the lower portion of reservoir 10 is in the shape of an elliptical indentation. Cylindrical storage compartment 14 is attached to one side of reservoir 10 and cylindrical storage compartment 16 is attached to the side of reservoir 10 opposite compartment 14. Hinged lid 18 closes the open top of compartment 16.

Water pistol 20 is located on the front of reservoir 20 and includes trigger 22, filling nozzle 24, spray nozzle 26, and an internal valve actuated by knob 28. Pistol 20 is held in place by supports 54, aligning nozzle 24 with the apex of hollow 12, which provides clearance for a balloon to swell while filling.

Lid 30 is on the top, flat surface of reservoir 10 and is preferably screwed on to make reservoir 10 air tight. Fitting 32 extends from the interior to the exterior of reservoir 10 and is connected to flexible tube 34 on the outside of the reservoir. Flexible tube 34 is of any desired length for connecting reservoir 10 to pistol 20. Rod 36 extends out from reservoir 10, terminating in handle 38. Handle 38 is locked in place by for carrying the reservoir or the handle is unlocked for pumping. Lock 40 is preferably a push and turn system in which handle 38 is pushed down as far as it will go and turned a quarter or half turn to lock the handle in place, as shown in phantom line in FIG. 1, to prevent the handle from moving vertically.

Figure 2:
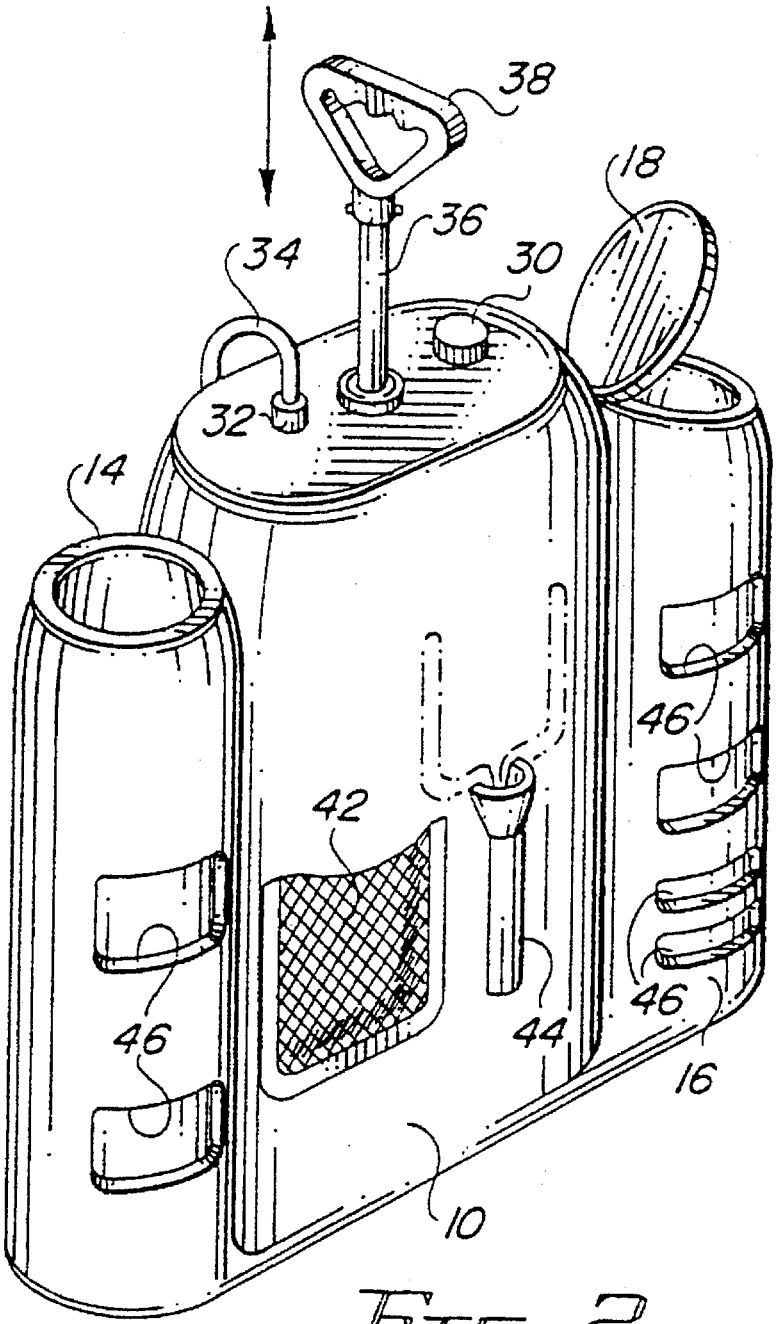
FIG. 2 is a perspective view of the rear of the dispenser of FIG. 1.

FIG. 2 is a rear view of reservoir 10. Netting 42 is attached to the rear surface of reservoir 10 along both sides and the bottom thereof. Also attached to the rear surface of reservoir 10 is holster 44, which is shaped to carry a slingshot for water balloons. Slits or voids 46 in the walls of compartments 14 and 16 facilitate draining water from the compartments and permit one to check the contents of the compartments.

Storage compartment 14 is designed to hold the detachable plastic bottles or containers from water pistols, such as from the water pistols commonly available in toy stores. Netting 42 is intended to carry empty water balloons, and holster 44 is intended to carry a slingshot for water balloons, providing a nice choice of weaponry for a combatant.

After filling a large number of balloons, one needs a convenient and safe place to store them to avoid breaking the balloons prematurely. Storage compartment 16 includes padding 74 for this purpose and includes hinged lid 18 for appearance and added protection. Slits or voids 46 permit water to drain out if a balloon breaks in a storage compartment.

Figure 3:
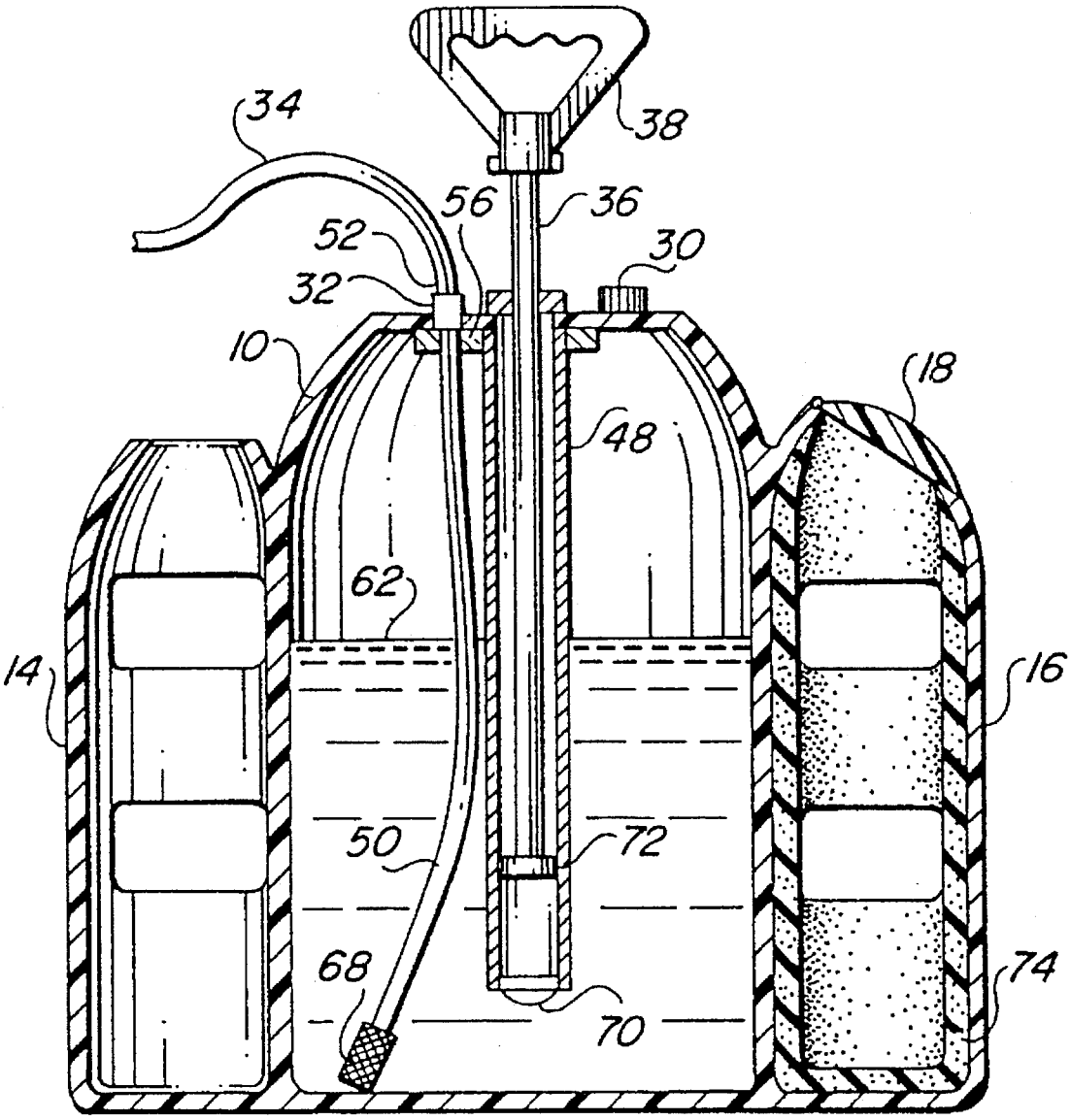
FIG. 3 is a cross-section of a portable dispenser constructed in accordance with a preferred embodiment of the invention.

FIG. 3 is a cross-section of a reservoir constructed in accordance with a preferred embodiment of the invention. Base 56 includes pump cylinder 48 and fitting 32 connected on the inside of reservoir 10 to the proximal end of discharge tube 50. Fitting 32 includes nipple 52 for connecting tube 34 to the reservoir. Filter 68 is attached to the distal end of discharge tube 50 for filtering water pumped into the tube. Check valve 70 at the bottom end of pump cylinder 48 prevents water from entering the cylinder as handle 38 is raised. Piston 72 is attached to rod 36 for pumping air into reservoir 10, thereby increasing the pressure within the reservoir. Padding 74 lines the interior of storage compartment 16.

Reservoir 10 is filled through lid 30 with a predetermined amount of water, indicated by reference number 62. Lid 30 is screwed on securely to make reservoir 10 air tight. Next, handle 38 is unlocked and moved vertically up and down, forcing air through check valve 70 on the downstroke. The air enters reservoir 10, increasing the pressure within the reservoir (and in tubes 50 and 34). As the process continues, reservoir 10 approaches a predetermined, optimal operating pressure.

Figure 4:
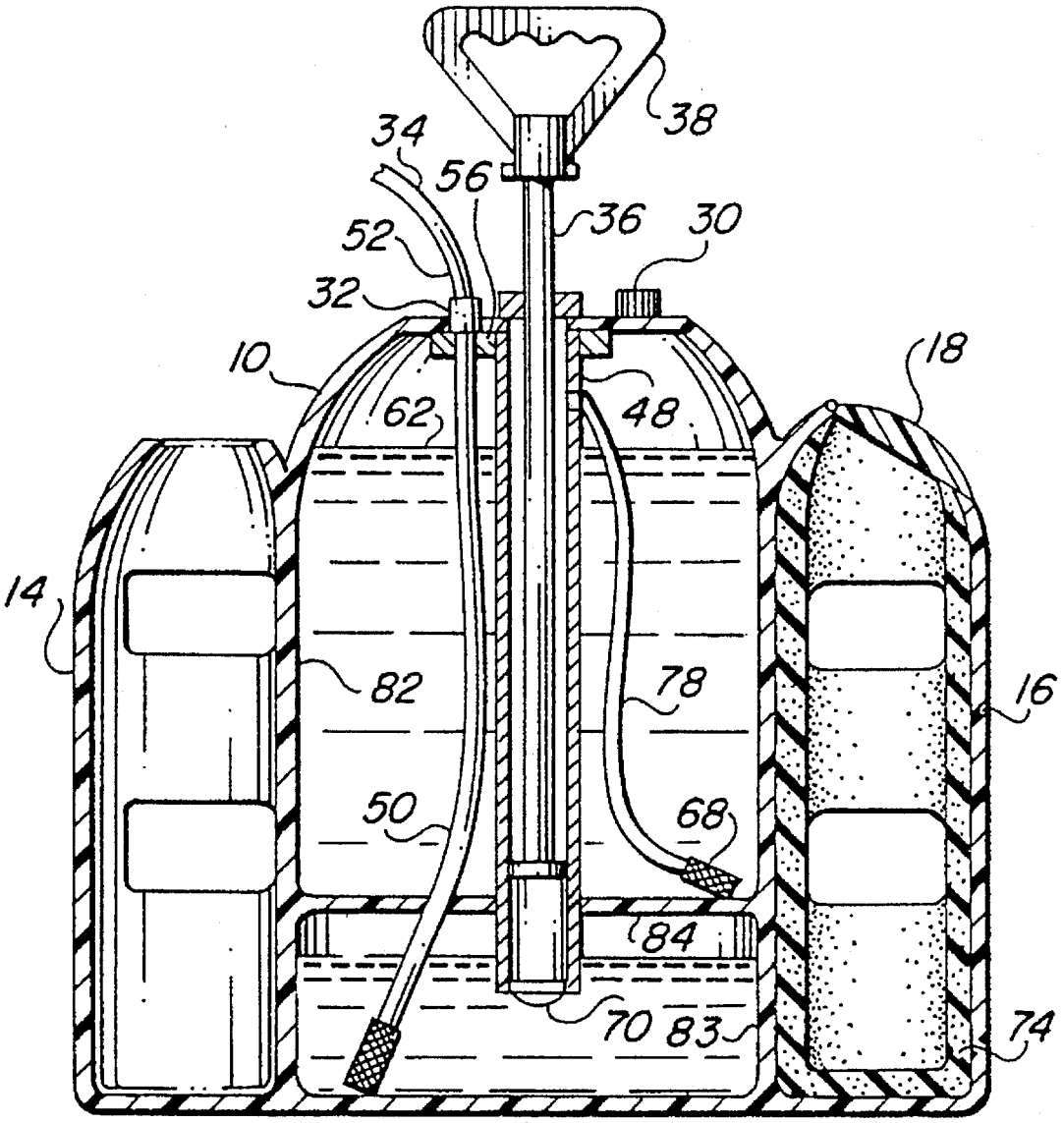
FIG. 4 is a cross-section of a portable dispenser constructed in accordance with an alternative embodiment of the invention.

FIG. 4 is a cross-section of a reservoir constructed in accordance with an alternative embodiment of the invention. In reservoir 10, partition 84 separates reservoir 10 into chamber 82 above the partition and chamber 83 below the partition. The lower chamber is pressurized by drawing water from the upper, unpressurized chamber through intake tube 78 and pumping the water into the lower chamber. Discharge tube 50 extends from fitting 32 through partition 84 to the bottom of the lower chamber. Pump cylinder 48 also extends through partition 84.

The embodiment illustrated in FIG. 4 pumps water rather than air. An advantage of this dispenser is that it allows a user to fill chamber 82 through the lid without losing the pressure that the pump has created, which is not possible with the embodiment of FIG. 1. Another important advantage of this embodiment is that the high pressure chamber is smaller, reducing the amount of rigid material capable of withstanding high pressures, thereby reducing the cost of producing the dispenser.

Figure 5:
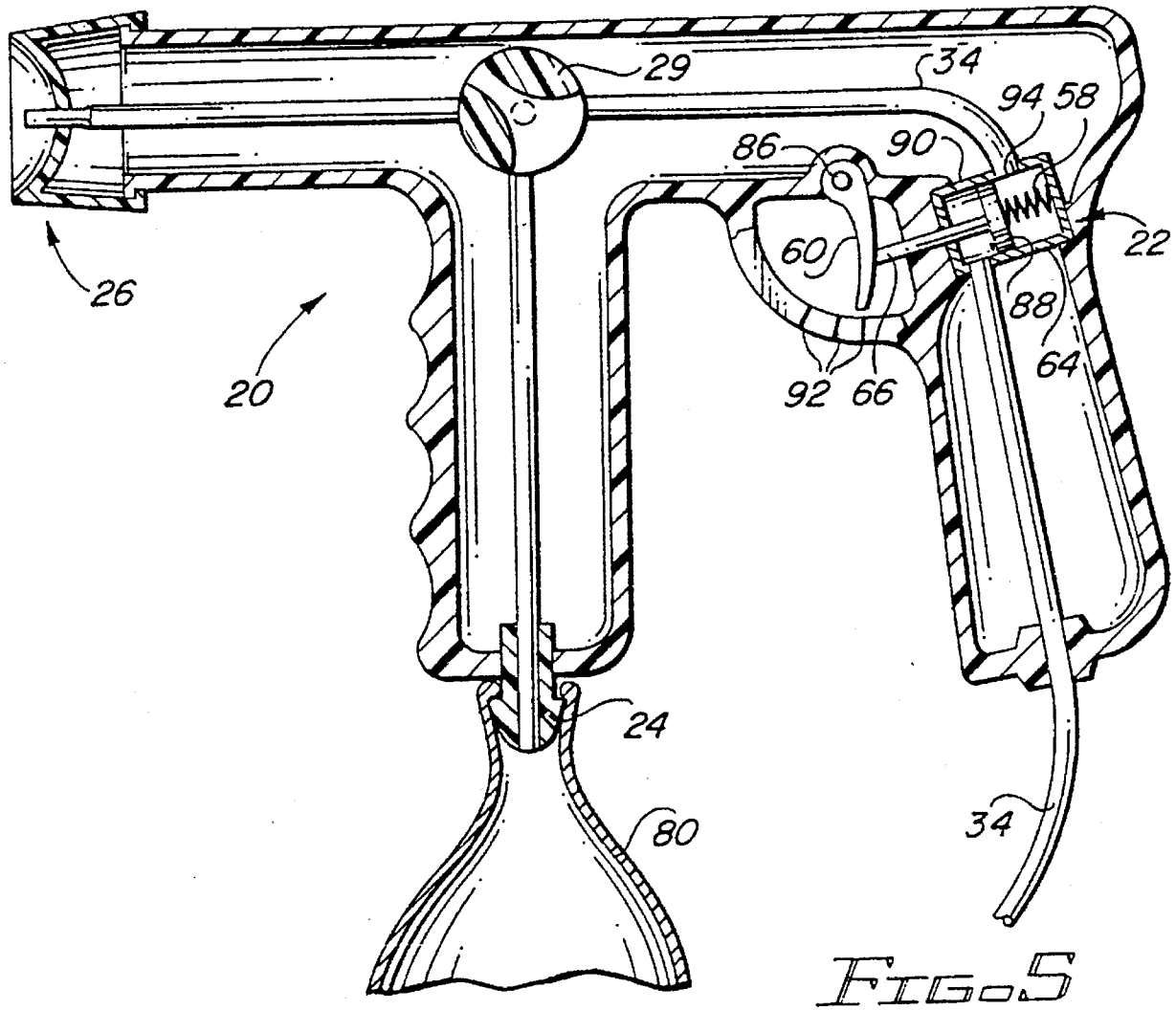
FIG. 5 is a cross-section of a water pistol constructed in accordance with a preferred embodiment of the invention.

FIG. 5 is a cross-section of pistol 20. Flexible tube 34 extends from reservoir 10 through the handle of pistol 20 to trigger mechanism 22. Trigger mechanism 22 is a relief valve, a pressure gauge, and a throttle for the water released by pistol 20. Trigger mechanism 22 preferably includes lever 60, which rotates about one end on pivot 86, and rod 66. Rod 66 enters chamber 64 and is connected to valve 88, which slides within the chamber. Spring 58 biases valve 88 in a first direction against stop 90 and the pressure of the water in tube 34 biases the valve in a second direction, opposite the first direction. At a predetermined maximum pressure, spring 58 yields enough for valve 88 to move past port 94, where the water can leave trigger mechanism 22 through a continuation of flexible tube 34.

When the pressure in tube 34 is less than a predetermined maximum, spring 58 and the water pressure cause valve 88 to reach an equilibrium position at some point upstream from port 94, closing the port. The movement of valve 88 is coupled to lever 60 by rod 66 and the free end of the lever is positioned adjacent one of a set of marks 92 on the trigger guard, thereby indicating the pressure in the reservoir.

Manually actuating lever 60 compresses spring 58 and moves valve 88 past port 94, allowing water to pass through trigger mechanism 22. Flexible tube 34 continues from trigger mechanism 22 to valve 29, where the water is directed either to filling nozzle 24 or to spray nozzle 26.

To fill a water balloon, the mouth of balloon 80 is placed over refilling nozzle 24 and valve 29 is turned to direct water to the refilling nozzle. With tube 34 under pressure, one gently squeezes lever 60. Valve 88 moves past port 94, permitting water to flow through the port to balloon 80. After balloon 80 is filled to a sufficient size, lever 60 is released. One can fill water pistols from nozzle 24 in the same manner. A water pistol or a water balloon can be filled when pistol 20 is hand-held or when pistol 20 is resting on supports 54 (FIG. 1).

The user can switch to spraying mode by rotating knob 28 (FIG. 1) to the proper position and then squeezing trigger 22, which will allow water to go past trigger 22, through valve 29, through spray nozzle 26, and out of the dispenser toward the target.

Figure 6:
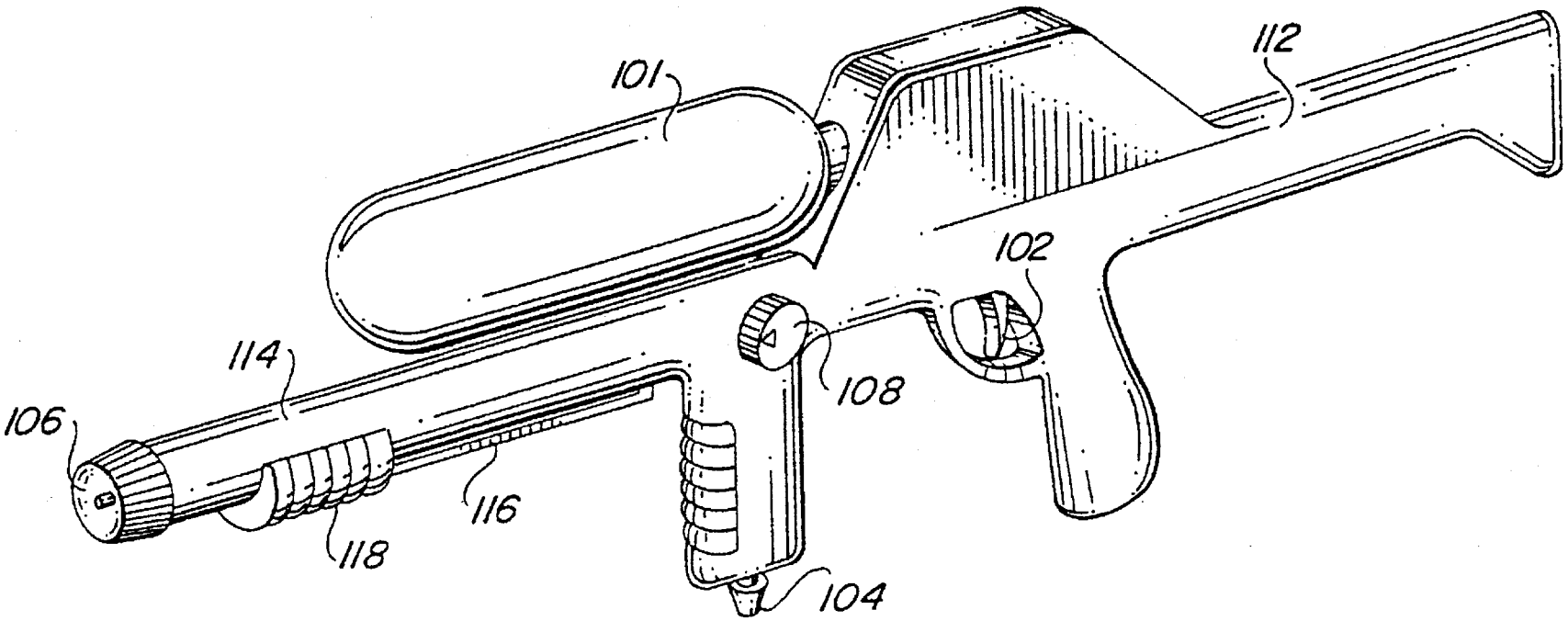
FIG. 6 is a perspective view of a water pistol in the shape of a rifle and constructed in accordance with the invention.

FIG. 6 illustrates a portable dispenser constructed in accordance with an alternative embodiment of the invention. Here the entire dispenser is hand-held and in the shape of a rifle. The dispenser includes pressurized container 101, trigger valve 102, filler nozzle 104, spraying nozzle 106, and selection knob 108. Gun stock 112 rests against the user's shoulder and reservoir 101 is pressurized by sliding pump handle 118 along barrel 114. The dispenser operates as described above and preferably includes marks on the trigger guard for indicating pressure. While this embodiment can carry less water, the rifle is more mobile and retains the advantages of being able to fill water balloons and water pistols.

The invention thus provides a portable dispenser for filling water balloons and water pistols easily and extending the range and duration of a water fight. The dispenser includes a nozzle that facilitates filling a water balloon or water pistol. The invention provides a cleaner way to fill balloons and water pistols and ensures that the fun and action of a water fight will not be interrupted by times out. The invention provides storage compartments for filled or empty water balloons, a holster for a slingshot for water balloons, a storage compartment for holding water pistols, and a pistol that produces a stream of water from a pressurized reservoir.

I claim:

1. A portable dispenser comprising:

a reservoir for storing liquid;

a first nozzle adapted to dispense liquid into a balloon;

pumping means for causing liquid to flow under pressure from said reservoir to said first nozzle;

control means for regulating the flow of liquid;

a first tube coupled between said reservoir and said control means;

a second tube coupled between said control means and said first nozzle; and a water pistol, wherein said water pistol contains said control means and said first nozzle and wherein said water pistol further includes a second nozzle, said second nozzle adapted for issuing a stream of liquid;

a selection valve having an inlet, a first outlet, and a second outlet, wherein said inlet is coupled to said control means, said first outlet is coupled to said first nozzle, and said second outlet is coupled to said second nozzle.

2. A portable dispenser comprising:

a reservoir for storing liquid;

a first nozzle adapted to dispense liquid into a balloon;

pumping means for causing liquid to flow under pressure from said reservoir to said first nozzle;

control means for regulating the flow of liquid;

wherein said control means includes a relief valve for relieving excess pressure within said reservoir;

a first tube coupled between said reservoir and said control means: and a second tube coupled between said control means and said first nozzle.

3. The portable dispenser as set forth in claim 2 wherein said control means includes means for indicating pressure within said reservoir.

4. The portable dispenser as set forth in claim 2 and further including a housing containing said first nozzle, said pumping means, said control means, said first tube, and said second tube, wherein said housing is in the shape of a rifle and said reservoir is attached to said housing.

5. A portable dispenser comprising:

a reservoir for storing liquid;

a first nozzle adapted to dispense liquid into a balloon;

pumping means for causing liquid to flow under pressure from said reservoir to said first nozzle;

control means for regulating the flow of liquid;

a first tube coupled between said reservoir and said control means;

a second tube coupled between said control means and said first nozzle; and a water pistol, said water pistol containing said control means and said first nozzle;

wherein said reservoir includes brackets on the outside thereof for holding said water pistol.

6. The portable dispenser as set forth in claim 5 wherein said reservoir includes a hollow indentation positioned near said bracket to align said first nozzle with said indentation to provide clearance for filling a balloon at said first nozzle when said pistol is held in said brackets.

7. A portable dispenser comprising;

a reservoir for storing liquid;

a first nozzle adapted to dispense liquid into a balloon;

pumping means for causing liquid to flow under pressure from said reservoir to said first nozzle;

control means for regulating the flow of liquid;

a first tube coupled between said reservoir and said control means;

a second tube coupled between said control means and said first nozzle; and a partition for dividing said reservoir into at least two chambers;

wherein a first of said chambers is unpressurized and a second of said chamber is pressurized; and said pumping means causes liquid to flow from said second of said chambers to said first nozzle.

8. The portable dispenser as set forth in claim 7 wherein said pumping means withdraws liquid from said first of said chambers and pumps liquid into the second of said chambers.

9. A portable dispenser comprising:

a reservoir for storing liquid;

a first nozzle adapted to dispense liquid into a balloon;

pumping means for causing liquid to flow under pressure from said reservoir to said first nozzle;

control means for regulating the flow of liquid;

a first tube coupled between said reservoir and said control means;

a second tube coupled between said control means and said first nozzle; and netting attached to said reservoir for storing unfilled balloons.

10. A portable dispenser comprising:

a reservoir for storing liquid;

a first nozzle adapted to dispense liquid into a balloon;

pumping means for causing liquid to flow under pressure from said reservoir to said first nozzle;

control means for regulating the flow of liquid;

a first tube coupled between said reservoir and said control means;

a second tube coupled between said control means and said first nozzle; and a holster attached to said reservoir for carrying a slingshot for water balloons.

11. A portable dispenser comprising:

a reservoir for storing liquid under pressure;

a pistol including a housing, a first nozzle extending from said housing and adapted to dispense liquid into a balloon, control means for regulating the flow of liquid within said housing, a second nozzle extending from said housing, said second nozzle adapted to issue a stream of liquid, a selection valve within said housing, said selection valve having an inlet, a first outlet, and a second outlet, wherein said inlet is coupled to said control means, said first outlet is coupled to said first nozzle, and said second outlet is coupled to said second nozzle; and a tube coupled between said reservoir and said control means.

12. The portable dispenser as set forth in claim 11 wherein said control means includes means for indicating pressure within said reservoir.

13. The portable dispenser as set forth in claim 12 wherein said control means includes a relief valve for relieving excess pressure within said reservoir.

14. A portable dispenser comprising;

a reservoir for storing liquid under pressure;

a pistol including a housing, control means for regulating the flow of liquid within said housing, for indicating pressure within said reservoir, and for relieving excess pressure within said reservoir;

a first nozzle extending from said housing, said first nozzle adapted to issue a stream of liquid;

a first tube coupled between said reservoir and said control means; and a second tube coupled between said control means and said first nozzle in said housing.

15. The portable dispenser as set forth in claim 14 wherein said control means includes a trigger coupled to said control means and extending from said housing, said housing includes a trigger guard, and said trigger guard includes a plurality of marks, whereby the position of said trigger relative to said marks indicates pressure within said reservoir.

16. The portable dispenser as set forth in claim 15 wherein said pistol includes:

a second nozzle extending from said housing and adapted to dispense liquid into a balloon, a selection valve within said housing, said selection valve having an inlet, a first outlet, and a second outlet, wherein said inlet is coupled to said control means, said first outlet is coupled to said first nozzle, and said second outlet is coupled to said second nozzle.

* * * * *